US008758205B2

(12) United States Patent
Huang et al.

(10) Patent No.: US 8,758,205 B2
(45) Date of Patent: Jun. 24, 2014

(54) REVERSIBLY SLIDE-SWINGABLE BALANCE-TRAINING APPARATUS

(75) Inventors: Jason Huang, Changhua County (TW); Wen-Chyuan Chen, Taoyuan County (TW)

(73) Assignee: B.Green Technology Co., Ltd., Sioushuei Township, Changhua County (TW)

( * ) Notice: Subject to any disclaimer, the term of this patent is extended or adjusted under 35 U.S.C. 154(b) by 362 days.

(21) Appl. No.: 13/241,609

(22) Filed: Sep. 23, 2011

(65) Prior Publication Data

US 2012/0208684 A1 Aug. 16, 2012

(30) Foreign Application Priority Data

Dec. 2, 2010 (TW) ..... 99141961 A

(51) Int. Cl.
*A63B 22/14* (2006.01)
*A63B 22/16* (2006.01)

(52) U.S. Cl.
USPC ..... 482/146

(58) Field of Classification Search
USPC ..... 472/95, 96, 97, 98, 99, 100, 101, 102, 472/103, 104, 105; 601/30, 31, 32, 50, 84, 601/85, 46, 53, 89; 482/1, 51, 110, 434, 482/142, 146, 145, 148, 77, 52, 79–80; D24/220, 231, 234; 73/669, 668, 1.77, 73/667; 366/111, 209, 211, 218, 332, 208, 366/110; 74/20–29
See application file for complete search history.

(56) References Cited

U.S. PATENT DOCUMENTS

2010/0234197 A1* 9/2010 Huang et al. ..... 482/142

* cited by examiner

*Primary Examiner* — Stephen Crow
*Assistant Examiner* — Rae Fischer
(74) *Attorney, Agent, or Firm* — Muncy, Geissler, Olds & Lowe, P.C.

(57) ABSTRACT

A reversibly slide-swingable balance-training apparatus includes a base unit, a transmission unit mounted in the base unit and providing a movement-constraining eccentric shaft and a power-maintaining rotary member for rotating the movement-constraining eccentric shaft continuously, one or a pair of linkages each having a first link pivotally connected to the movement-constraining eccentric shaft of the transmission unit, a second link pivotally coupled between the first link and the base unit and a third link pivotally connected to the second link, and a platform pivotally connected to the first link and third link of each linkage. Subject to the oscillation motion of the links of the linkage counteracting the postures of the user and the functioning of the movement-constraining eccentric shaft and the continuation of the energy of the power-maintaining rotary member, the platform is reversibly slide-swinging for best balance training.

17 Claims, 5 Drawing Sheets

REVERSIBLY SLIDE-SWINGABLE BALANCE-TRAINING APPARATUS

BACKGROUND OF THE INVENTION

1. Field of the Invention

The present invention relates to physical training apparatus and more particularly, to a balance training platform, which is reversibly slide-swingable subject to user's control.

2. Description of the Related Art

The structural designs of conventional balance-training equipments commonly emphasize the functioning of balance training without combining the functioning of continuous muscle training, i.e., conventional balance-training equipments cannot be controlled to provide a continuously reciprocating motion subject to the user's posture and energy. In consequence, conventional balance-training equipments may be unable to achieve the expected training effects.

Therefore, there is a room for improvement on conventional balance-training equipments. In view of the aforesaid situation, the invention has been created.

SUMMARY OF THE INVENTION

The present invention has been accomplished under the circumstances in view. It is the main object of the present invention to provide a reversibly slide-swingable balance-training apparatus, which utilizes a simple linking and transmission structure to perform expected motions positively and accurately and allows the user to control the operation actively.

To achieve this and other objects of the present invention, a reversibly slide-swingable balance-training apparatus comprises a base unit, a transmission unit mounted in the base unit and providing a movement-constraining eccentric shaft defining a center of gyration and a power-maintaining rotary member for rotating the movement-constraining eccentric shaft continuously counteracting the postures of the user using the reversibly slide-swingable balance-training apparatus, one or a pair of linkages arranged on the base unit each having a first link pivotally connected to the movement-constraining eccentric shaft of the transmission unit, a second link pivotally coupled between the first link and the base unit and a third link pivotally connected to the second link, and a platform pivotally connected to the first link and third link of each linkage. Subject to the oscillation motion of the links of the linkage counteracting the postures of the user and the functioning of the movement-constraining eccentric shaft and the continuation of the energy of the power-maintaining rotary member, the platform is reversibly slide-swinging for best balance training.

Other advantages and features of the present invention will be fully understood by reference to the following specification in conjunction with the accompanying drawings, in which like reference signs denote like components of structure.

DETAILED DESCRIPTION OF THE INVENTION

Figure 1:
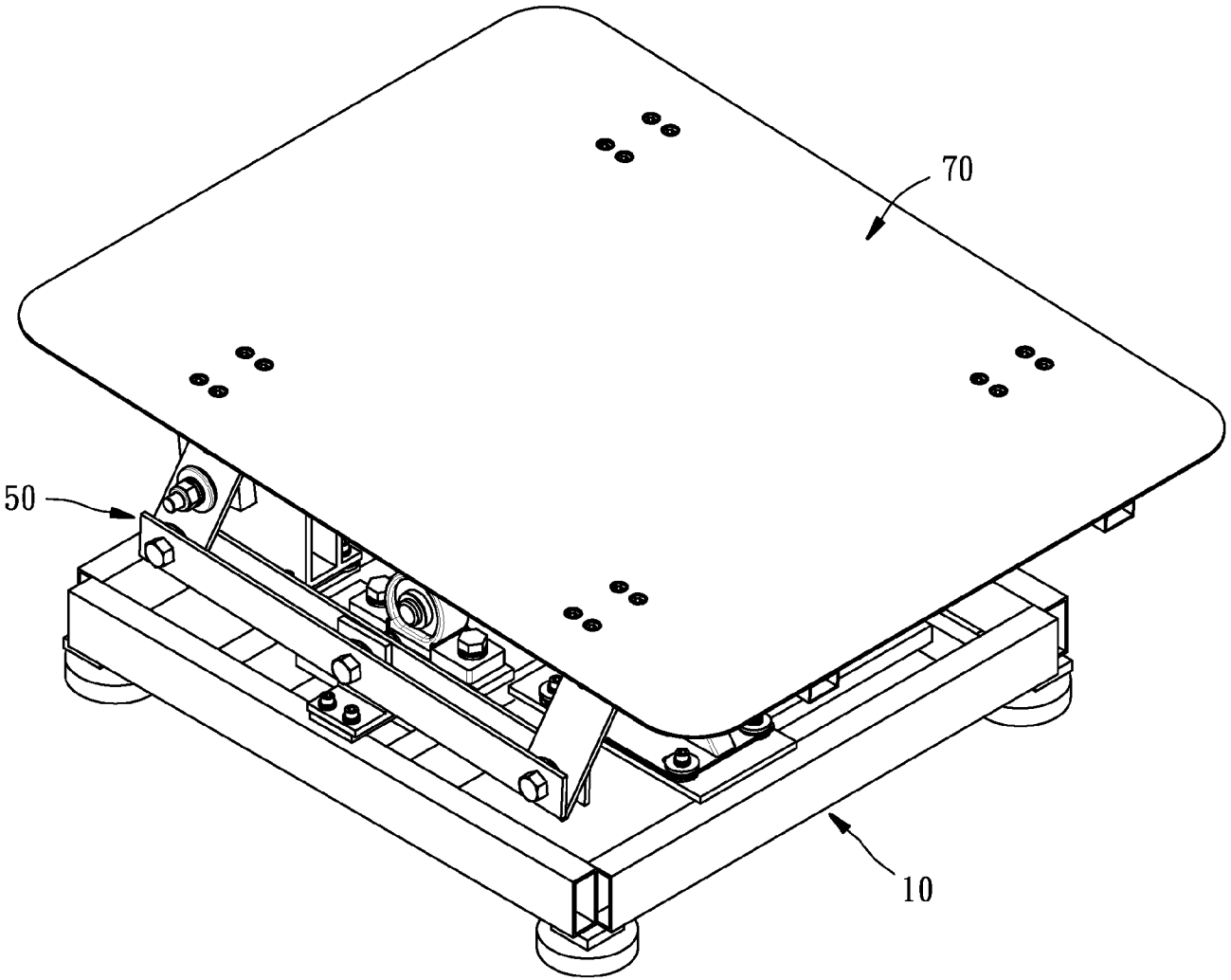
FIG. 1 is an elevational view of a reversibly slide-swingable balance-training apparatus in accordance with the present invention.
Figure 2:
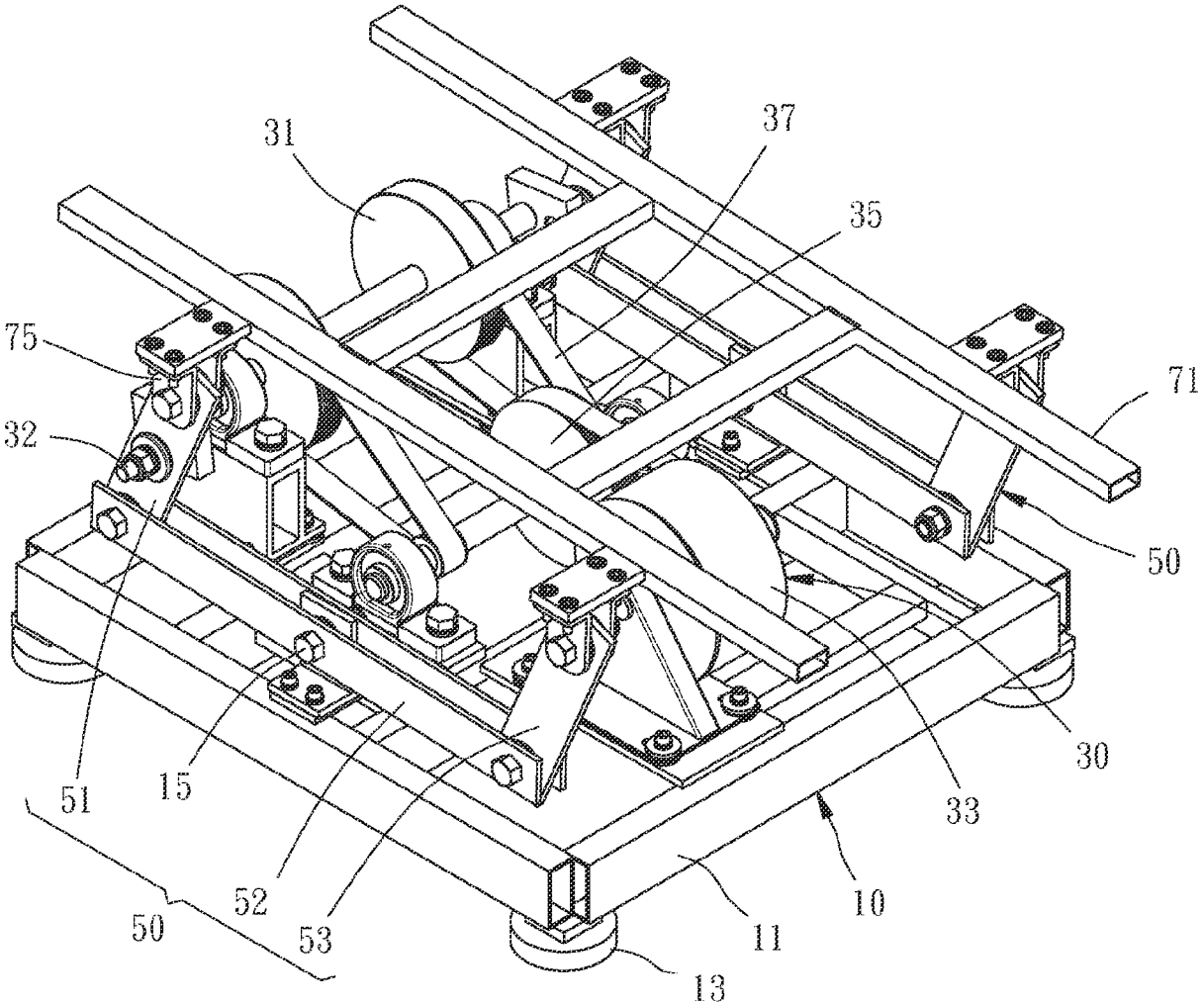
FIG. 2 corresponds to FIG. 1, illustrating the status of the reversibly slide-swingable balance-training apparatus after removal of the table.
Figure 3:
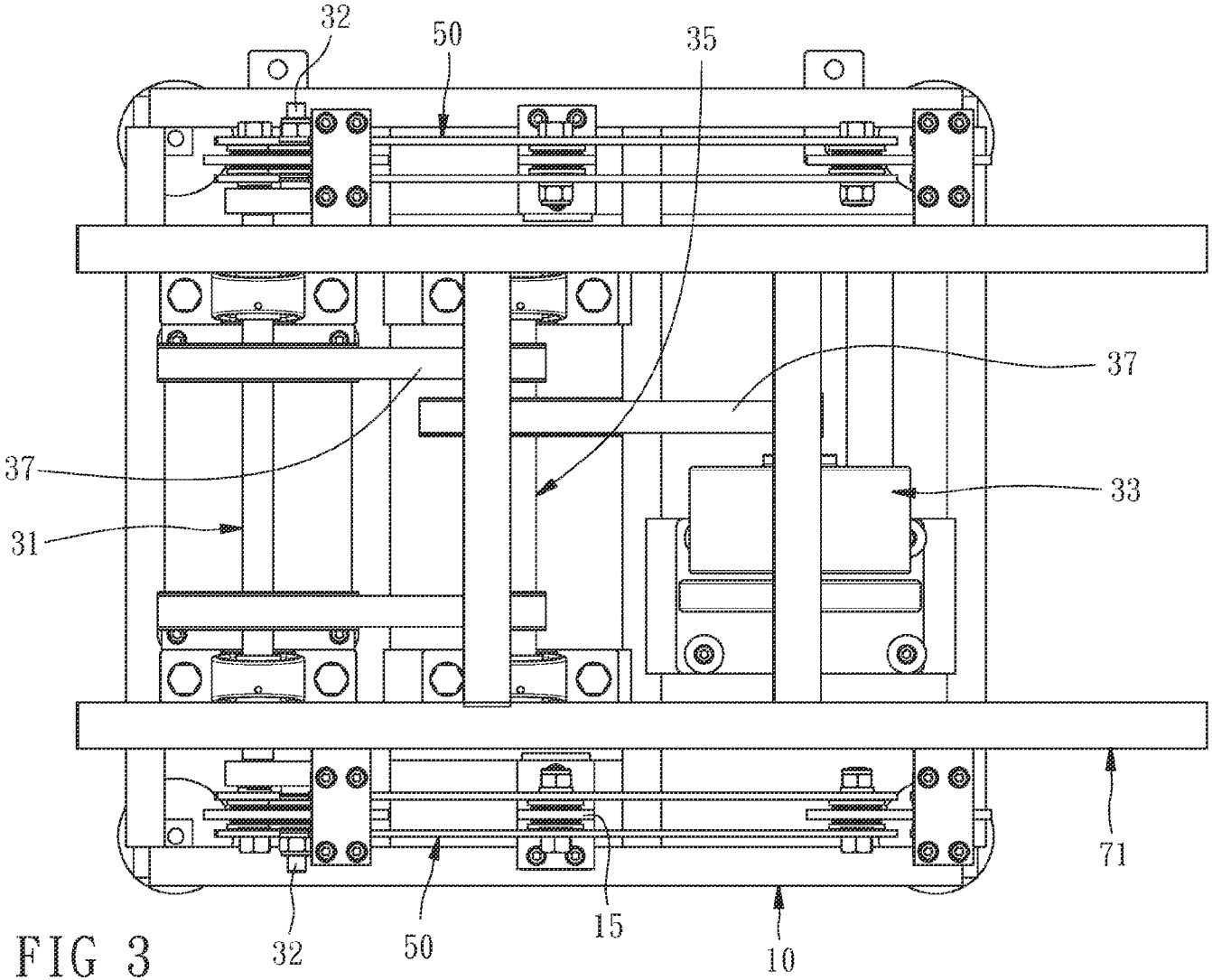
FIG. 3 is a top view of FIG. 2.

Referring to FIGS. 1-4, a reversibly slide-swingable balance-training apparatus in accordance with the present invention is shown comprising a base unit 10, which comprises a frame member 11, four foot members 13 connected to the frame member 11 in four corners, a plurality of link connection members 15 and a plurality of wheel axle connection members (not shown);

a transmission unit 30, which is mounted in the base unit 10, comprising a transmission wheel set 31, a movement-constraining eccentric shaft 32 connected to the first transmission wheel set 31 and turnable about a center of gyration 321, and a power-maintaining rotary member 33 for rotating the eccentric shaft 32, wherein the power-maintaining rotary member 33 is a flywheel 33; the center of rotation of the flywheel 33 is kept in a parallel manner relative to the center of gyration 321 so that the flywheel 33 can rotate the movement-constraining eccentric shaft 32 indirectly;

two transmission belts 37 coupled between the flywheel 33 and the movement-constraining eccentric shaft 32, wherein one transmission belt 37 is coupled between the flywheel 33 and a reducing gear set 35, and the other transmission belt 37 is coupled between the reducing gear set 35 and the transmission wheel set 31, and therefore, the movement-constraining eccentric shaft 32 is indirectly rotatable by the transmission belts 37;

two linkages 50 respectively arranged on the base unit 10 at two opposite lateral sides in a parallel manner, each comprising a first link 51 pivotally connected to the movement-constraining eccentric shaft 32, a second link 52 pivotally coupled between the first link 51 and the base unit 10, and a third link 53 pivotally connected to the second link 52; and a platform 70, which comprises a base frame 71, a faceplate 73 fixedly mounted on the base frame 71, and a plurality of connection members 75 fixedly located on the bottom side of the base frame 71 and respectively pivotally connected to the first links 51 and third links 53 of the linkages 50.

Thus, the platform 70 is pivotally connected to the first links 51 and third links 53 of the linkages 50.

Further, the second link 52 of each linkage 50 has its one end pivotally connected to the associating first link 51, its middle part pivotally coupled to the base unit 10, and its other end pivotally connected to one end of the third link 53, which has the other end pivotally connected to the platform 70.

Further, the reversibly slide-swingable balance-training apparatus may use simply one single linkage 50, achieving the same effects.

Figure 4:
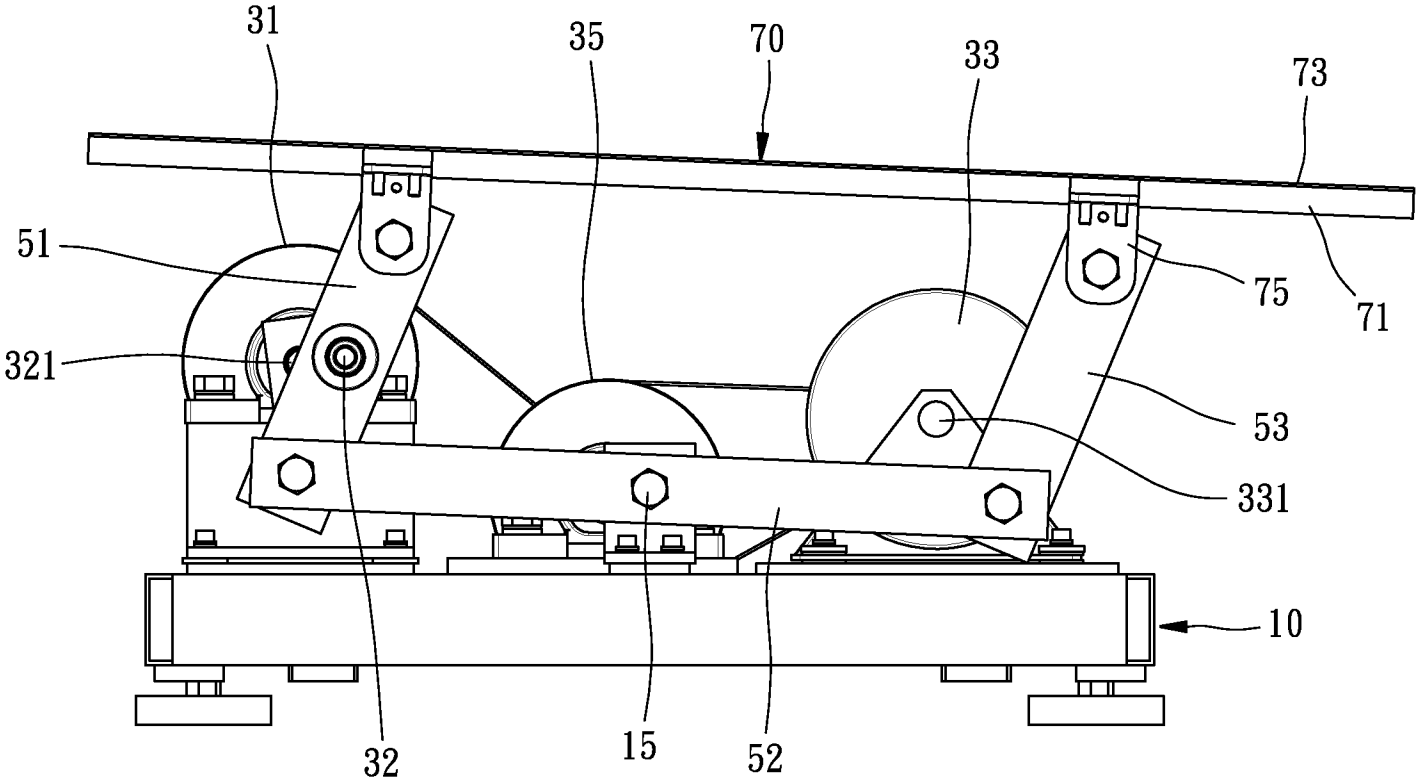
FIG. 4 is a schematic front view of the present invention, illustrating an operation status of the reversibly slide-swingable balance-training apparatus.
Figure 5:
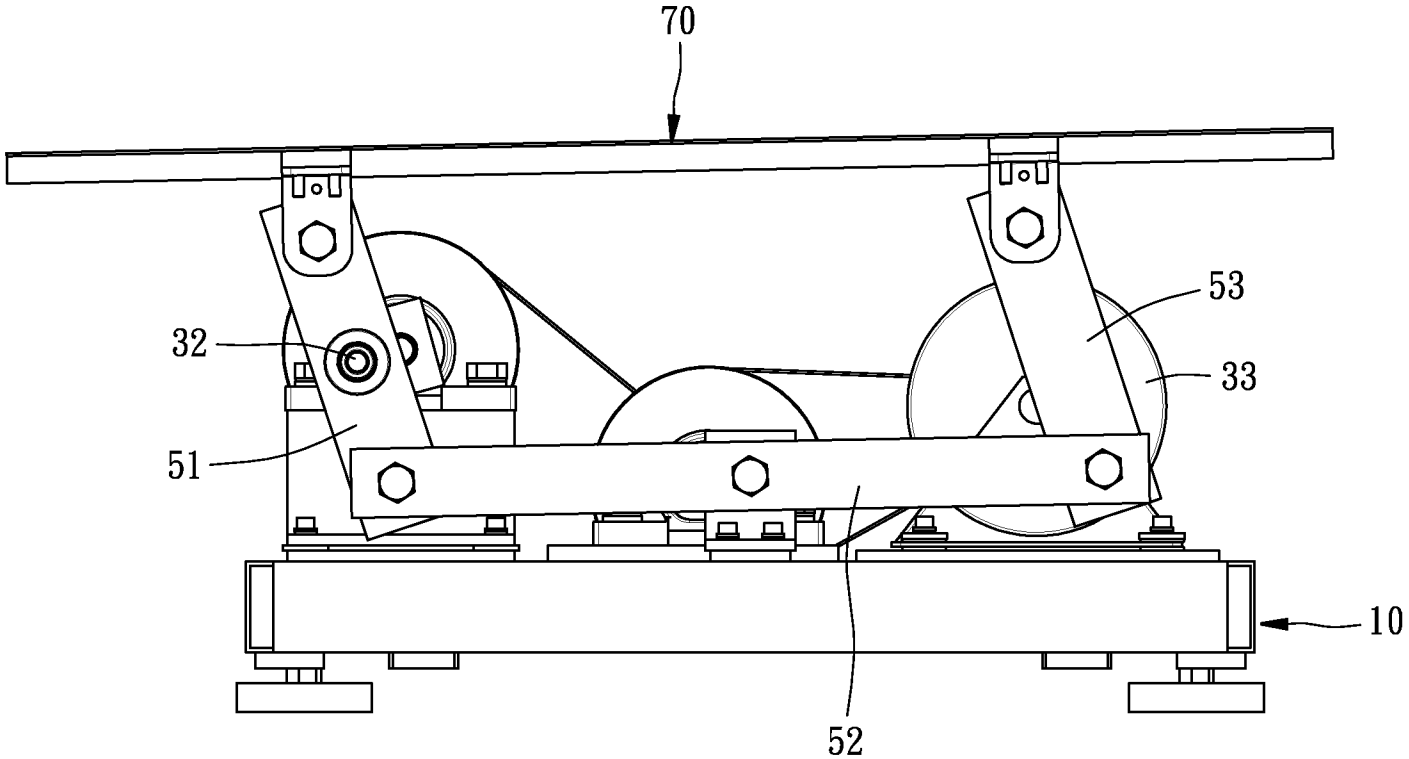
FIG. 5 is similar to FIG. 3, illustrating another operation status of the reversibly slide-swingable balance-training apparatus.

FIG. 4 illustrates one operation status of the reversibly slide-swingable balance-training apparatus. FIG. 5 illustrates another operation status of the reversibly slide-swingable balance-training apparatus. As shown in FIG. 5, when the movement-constraining eccentric shaft 32 is rotated to another angle (azimuth), the first link 51 of each linkage 50 is turned about the center of the associating movement-constraining eccentric shaft 32 to bias the associating second link 52 on the pivot center between the associating second link 52 and the base unit 10, and the associating third link 53 is biased subject to the movement of the associating second link 52. Thus, the first link 51, second link 52 and third link 53 of each linkage 50 and the platform 70 work as a four-bar linkage, reversibly slide-swinging the platform 70 for balance training.

Thus, a user can stand on the platform 70 to reversibly exercise balance training. More particularly, the arrangement of the inertia flywheel 33 provides a movement of high inertia to the user, rendering appropriate assistance to the user as the user is operating the machine. Further, the user can control the operation speed subject to one's preference during exercise. Further, the structural design of the present invention enables the machine to perform the actions of forward inclination, backward inclination and sliding, achieving optimal balance training and muscular strength exercising effects.

Further, subject to a proper speed reduction ratio, the inertia flywheel 33 can be rapidly rotated to provide the expected amount of inertia. On the contrary, the amount of inertia of the inertia flywheel 33, subject to a proper speed reduction ratio, enables the number of motion cycles of the platform 70 to be less than the number of runs of the inertia flywheel 33. Thus, the machine provides the desired amount of inertial and operation speed.

Further, except the aforesaid preferred embodiment, the reversibly slide-swingable balance-training apparatus may be modified as follows:

For example, in the aforesaid preferred embodiments, two linkages 50 are respectively arranged at the left and right sides, however, one single linkage 50 can be used to achieve the same effects.

Or, a magnetic damping device comprising a flywheel may be used to substitute for the aforesaid inertia flywheel 33, i.e., the power-maintaining rotary member 33 of the transmission unit 30 can be a magnetic damping device comprising a flywheel.

Or, the center of rotation 331 of the flywheel 33 can be same as the center of gyration of the eccentric shaft 32 for direct movement, i.e., the transmission unit 30 comprises a movement-constraining eccentric shaft 32 defining a center of gyration 321, and a power-maintaining rotary member 33 for rotating the movement-constraining eccentric shaft 32.

Or, the second link 52 of each linkage 50 can be pivotally coupled between the transmission unit 30 and the platform 70, instead of the arrangement of the aforesaid preferred embodiment to have the second link 52 be pivotally coupled to the first link 51.

Or, in an alternate form, the transmission unit 30 comprises a reducing gear set 35 adapted for rotating the movement-constraining eccentric shaft 32 and the power-maintaining rotary member 33.

In conclusion, the invention provides a reversibly slide-swingable balance-training apparatus, which utilizes a simple linking and transmission structure to perform expected motions positively and accurately, achieving balance training and muscular strength training and allowing the user to control the operation actively subject to one's preference.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A reversibly slide-swingable balance-training apparatus, comprising:

a base unit;

a transmission unit mounted in said base unit, said transmission unit comprising a movement-constraining eccentric shaft defining a center of gyration, and a power-maintaining rotary member for rotating said movement-constraining eccentric shaft continuously counteracting the postures of the user using the reversibly slide-swingable balance-training apparatus;

at least one linkage arranged on said base unit, each said linkage comprising a first link pivotally connected to said movement-constraining eccentric shaft of said transmission unit, a second link pivotally coupled between said first link and said base unit and a third link pivotally connected to said second link; and a platform pivotally connected to said first link and said third link of each said linkage.

2. The reversibly slide-swingable balance-training apparatus as claimed in claim 1, wherein said power-maintaining rotary member is an inertia flywheel.

3. The reversibly slide-swingable balance-training apparatus as claimed in claim 2, wherein the center of rotation of said power-maintaining rotary member is same as the center of gyration of said movement-constraining eccentric shaft, allowing said power-maintaining rotary member to rotate said movement-constraining eccentric shaft directly.

4. The reversibly slide-swingable balance-training apparatus as claimed in claim 2, wherein the center of rotation of said power-maintaining rotary member is kept in a parallel manner relative to the center of gyration of said movement-constraining eccentric shaft, allowing said power-maintaining rotary member to rotate said movement-constraining eccentric shaft indirectly.

5. The reversibly slide-swingable balance-training apparatus as claimed in claim 2, further comprising a belt transmission means coupled between said power-maintaining rotary member and said movement-constraining eccentric shaft.

6. The reversibly slide-swingable balance-training apparatus as claimed in claim 2, wherein said transmission unit further comprises a reducing gear set coupled between said power-maintaining rotary member and said movement-constraining eccentric shaft.

7. The reversibly slide-swingable balance-training apparatus as claimed in claim 1, wherein said power-maintaining rotary member is a magnetic damping device comprising a flywheel.

8. The reversibly slide-swingable balance-training apparatus as claimed in claim 7, wherein the center of rotation of said power-maintaining rotary member is same as the center of gyration of said movement-constraining eccentric shaft, allowing said power-maintaining rotary member to rotate said movement-constraining eccentric shaft directly.

9. The reversibly slide-swingable balance-training apparatus as claimed in claim 7, wherein the center of rotation of said power-maintaining rotary member is kept in a parallel manner relative to the center of gyration of said movement-constraining eccentric shaft, allowing said power-maintaining rotary member to rotate said movement-constraining eccentric shaft indirectly.

10. The reversibly slide-swingable balance-training apparatus as claimed in claim 7, further comprising a belt transmission means coupled between said power-maintaining rotary member and said movement-constraining eccentric shaft.

11. The reversibly slide-swingable balance-training apparatus as claimed in claim 7, wherein said transmission unit further comprises a reducing gear set coupled between said power-maintaining rotary member and said movement-constraining eccentric shaft.

12. The reversibly slide-swingable balance-training apparatus as claimed in claim 1, wherein the center of rotation of said power-maintaining rotary member is same as the center of gyration of said movement-constraining eccentric shaft, allowing said power-maintaining rotary member to rotate said movement-constraining eccentric shaft directly.

13. The reversibly slide-swingable balance-training apparatus as claimed in claim 1, wherein the center of rotation of said power-maintaining rotary member is kept in a parallel manner relative to the center of gyration of said movement-constraining eccentric shaft, allowing said power-maintaining rotary member to rotate said movement-constraining eccentric shaft indirectly.

14. The reversibly slide-swingable balance-training apparatus as claimed in claim 1, further comprising a belt transmission means coupled between said power-maintaining rotary member and said movement-constraining eccentric shaft.

15. The reversibly slide-swingable balance-training apparatus as claimed in claim 1, wherein said transmission unit further comprises a reducing gear set coupled between said power-maintaining rotary member and said movement-constraining eccentric shaft.

16. The reversibly slide-swingable balance-training apparatus as claimed in claim 1, wherein said second link of each said linkage has one end thereof pivotally connected to said first link, a middle part thereof pivotally connected to said base unit, and an opposite end thereof pivotally connected to one end of said third link.

17. The reversibly slide-swingable balance-training apparatus as claimed in claim 1, wherein said second link of each said linkage has one end thereof pivotally connected to said base unit, a middle part thereof pivotally connected to said first link, and an opposite end thereof pivotally connected to transmission unit.

* * * * *